US007369039B1

(12) United States Patent
Knutson

(10) Patent No.: US 7,369,039 B1
(45) Date of Patent: May 6, 2008

(54) WAITER CALL LIGHT (WCL)

(75) Inventor: Kirk Michael Knutson, 518 Banyan Cir., Walnut Creek, CA (US) 94598

(73) Assignee: Kirk Michael Knutson, Walnut Creek, CA (US)

( * ) Notice: Subject to any disclaimer, the term of this patent is extended or adjusted under 35 U.S.C. 154(b) by 169 days.

(21) Appl. No.: 11/323,445

(22) Filed: Dec. 31, 2005

(51) Int. Cl.
*G08B 5/00* (2006.01)
*H05B 39/00* (2006.01)
*H05B 41/00* (2006.01)

(52) U.S. Cl. ..... 340/332; 340/286.09; 340/321; 340/815.4

(58) Field of Classification Search ..... None
See application file for complete search history.

(56) References Cited

U.S. PATENT DOCUMENTS 1,714,333 A * 5/1929 Voss ..... 116/324
2,465,426 A * 3/1949 Bralove ..... 340/321
2,638,583 A * 5/1953 Edwards, Jr. ..... 340/321
3,810,164 A * 5/1974 Lambert ..... 340/332
4,250,491 A * 2/1981 Dotson ..... 340/321
4,926,786 A * 5/1990 White ..... 116/324
5,124,683 A * 6/1992 Brunner ..... 340/323 R
5,400,234 A * 3/1995 Yu ..... 362/396
5,489,887 A * 2/1996 Porras ..... 340/332
5,828,294 A * 10/1998 Shank ..... 340/326
6,164,796 A * 12/2000 La Chiusa ..... 362/122
6,366,196 B1 * 4/2002 Green et al. ..... 340/286.09

* cited by examiner

*Primary Examiner*—Benjamin C. Lee
*Assistant Examiner*—Son Tang

(57) ABSTRACT

The restaurant business is often a fast paced, stressful, and confusing business to work in. Servers frequently have a hard time guessing patron needs and patrons often find it difficult to gain the servers attention. Sometimes patrons want to be left alone with their meal or conversation only to be interrupted by a server, creating an uncomfortable situation for both patron and server. With the Waiter Call Light, patrons can gain the servers attention with a push of a button. With it's side mounted light source the server can easily know (even from across the room) when the customer requires attention. This will increase efficiency in communication between server and patron. Table turn over times can be significantly decreased, which helps shorten wait times, allows for more customers to be served, increases restaurant sales/profits, all while making the dining experience easier and more pleasurable for both server and customer.

7 Claims, 5 Drawing Sheets

WAITER CALL LIGHT (WCL)

CROSS REFERENCES TO RELATED APPLICATIONS

There have been other waiter signaling devices such the electronic paging systems and the visual display signaling lights listed below. These inventions proved to be too expensive to produce or are less practical in their usage.

There is a U.S. Pat. No. 5,699,039 to Korzen which is an illuminated menu stand that is similar but doesn't offer enough practicality in its application. Whenever a table needs to be cleaned or if patrons move this device around it may become hard to see from the waiters' perspective or easily confused with other items on the table. The WCL would be anchored (clipped on to the edge of the table) or embedded in the table and the light would be seen easily from the side of the table where there is no other inhibiting distractions to compete with the light's visibility.

There is U.S. Pat. No. 6,050,214 to O Keefe which is a device that has a movable indicator that is attached to a portfolio, payment tray (or the such), a device on the table or another structure such as a table edge. This invention cannot offer the visibility of the WCL especially under low light serving conditions and patrons may easily be confused by the coloring system and indicator.

There is U.S. Pat. No. 5,489,887 to Porras which is a waiter signaling device that has a light attached to a pole which clamps on to the table. This design can pose major problems for both the patron and the waiter. Patrons may be distracted by the pole when ordering and waiters may find it very difficult to maneuver over when serving. The WCL would not have these problems because of the side mounted light and the low profile.

There is U.S. Pat. No. 4,250,491 to Dotson which is similar to the previous listed device but this one has a light that can be raised and lowered by a movable pole. Again this is top mounted making it a distraction to table top conditions (such as room for food, bumping it with table top items, etc.). This design presents an inconvenience to both the patron and waiter in that the patron has the responsibility of raising the light to gain the servers attention and the waiter has the responsibility of lowering the light when they have fulfilled the customers needs.

Other similar devices like U.S. Pat. No. 5,272,474 to Hilliard and U.S. Pat. No. 4,935,720 to Kalfoun are similar devices with visual indicators but are too complex for restaurant workers or patrons to use and/or are expensive to produce. Additional devices that may be covered or fall into this category may have similar functions or intent but none have the simplicity in function or design that is comparable to the WCL.

All these inventions listed are all very much different in design and/or intent. The WCL's unique side mounted (table edge) light and single table top button, allows for a much more waiter and patron friendly usage. It's simplicity in design allows the WCL to be very cost effective to produce and much more practical than other devices covered in this category. It's unique design allows for optimum table top activity (such as waiter ease in food serving, patron usage and space allowance, optimum signal visibility, table cleaning, etc.).

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

Eating in a restaurant is a wide spread activity enjoyed by many and considered a necessity to some. Patrons often find themselves needing items such as a fork, a condiment, the bill, etc. and often it is hard for the patron to gain the waiter's attention when they need something. The waiter also has the problem of knowing an individual customer's needs such as when to take an order, an appropriate time to check if the patron needs anything to go with their meal such a beverage refill, etc. Often patrons find themselves in positions of time constraint and don't have a lot of time to spend in a restaurant. Sometimes the patron finds the waiter to be disruptive such as when a waiter shows up to ask about the meal while the patron has food in their mouth or is trying to enjoy their meal without interruption. With the Waiter Call Light (WCL) all of these problems can be easily solved. With a touch of a button the customer can easily gain the waiter's attention making the experience between both the waiter and patron a lot smoother and more efficient (eliminating the frustration and guess work). With increased efficiency and table turnover times, potential customers won't be discouraged and leave due to long wait times to get a table.

Other inventions in this category, which may be similar in purpose, have one or more problems not associated with the WCL such as; being too complex (both in design and patron usage), not cost effective to produce and/or use, distracting for both the patron and waiter, limit table space, etc. With it's flat, slim, compact, table top mounted water proof button, side mounted light, patron and waiter friendly, simple construction design, the WCL does away with the problems of previous inventions in this field.

BRIEF SUMMARY OF THE INVENTION

The Waiter call light (WCL) is a (stainless steel, painted metal, rust resistant metal or even heavy duty plastic) clip that has a table top mounted waterproof (optional illuminating) button (on/off), a side mounted light source (front edge/side of table), and a bottom (concealed) mounted battery pack. It can be permanently attached to a table with screws, utilizing the screw holes on the underside of the WCL, from underneath a table. Designer plastic caps (attachable accent covers for the light) can be used to change light colors or to illuminate a restaurant's personal logo or design. The WCL also has a rubber lining on the inside of the of the clip (part that sticks to table) to ensure a non slip secure fit. The rubber lining also conceals and protects the wires used to connect the battery source, light, and button. The bottom (underside) of the clip edge can be straight or folded to ensure proper grip. A rechargeable battery can be utilized for long life.

With it's flat, slim, compact size, table top mounted water proof button, side (highly visible) mounted light source/bulb, removable designer light attachment caps/covers, patron and waiter friendly usage, simple construction design, the WCL does away with the problems of previous inventions in this field. The WCL is designed to minimize distractions to both patron and waiter, taking up minimal space on tables being served. The WCL is very cost-effective to produce, install, and use. The WCL can be easily integrated to any existing food service process and workflow. The WCL optimizes interaction between patrons of restaurants and waiters to increase productivity (allowing more customers to be served due to increased efficiency), customer satisfaction, and restaurant profits. This results in decreased stress levels in the waiters' work environment. Restaurant owners can also customize the look of the WCL to compliment the decor and motif of the restaurant.

BRIEF DESCRIPTION OF THE SEVERAL VIEWS OF THE DRAWINGS

In reference to the drawings,

The view in FIG. 8 shows the WCL attached to a table 10. In FIG. 8 a waitress 11 is shown observing (line of sight 12) the illuminated light source 3 indicating that her customers require her services.

DETAILED DESCRIPTION OF THE INVENTION

Figure 1:
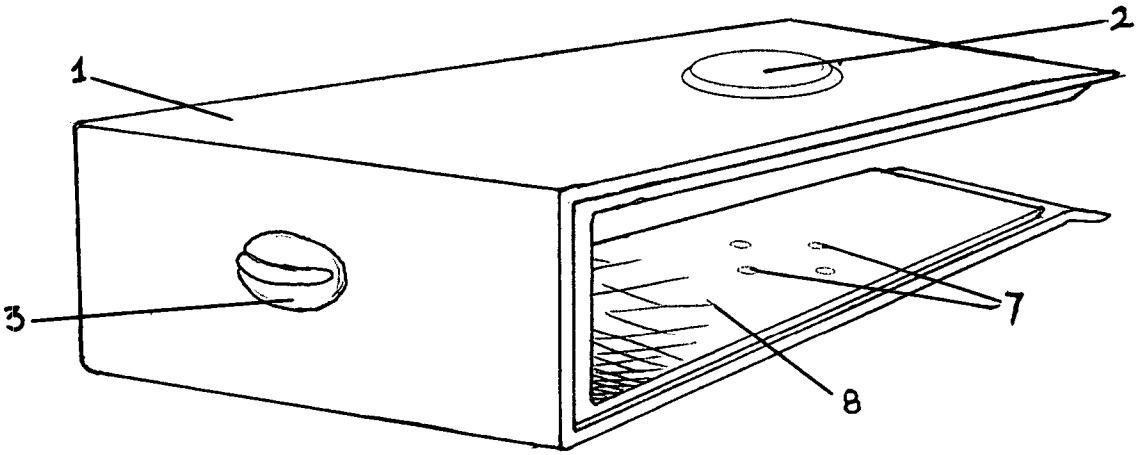
FIG. 1 is a three dimensional representation of the WCL. The first component labeled 1 is the body or frame of the WCL which is a clip that attaches to the side of a table. The WCL is activated by pressing a button 2 that activates the light source 3. The light source 3 consists of a light bulb 4 and an optional designer cap 5 which would go over the bulb 4 to help match restaurant decor. The light source is powered by batteries located within the battery pack 6 attached to the underside of the WCL body 1. When attached to a table the WCL can be more permanently secured with screws through the pre-drilled screw holes 7 located on the underside of the WCL frame 1. Lining the inside of the WCL body 1 is a layer of rubber 8 which provides a non-slip surface to help secure the WCL to the table. The rubber layer 8 also provides a protective cover and insulation for the wiring 9 as shown in FIG. 3 (wiring diagram), which links the battery pack 6, light source 3, and the button 2 together.
Figure 2:
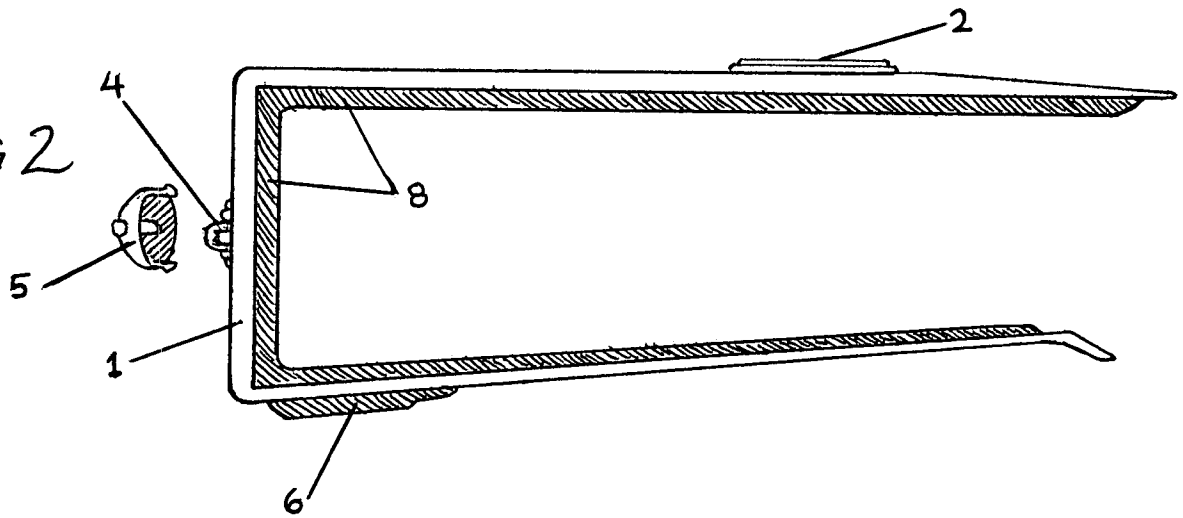
FIG. 2 is a side view of the WCL.
Figure 3:
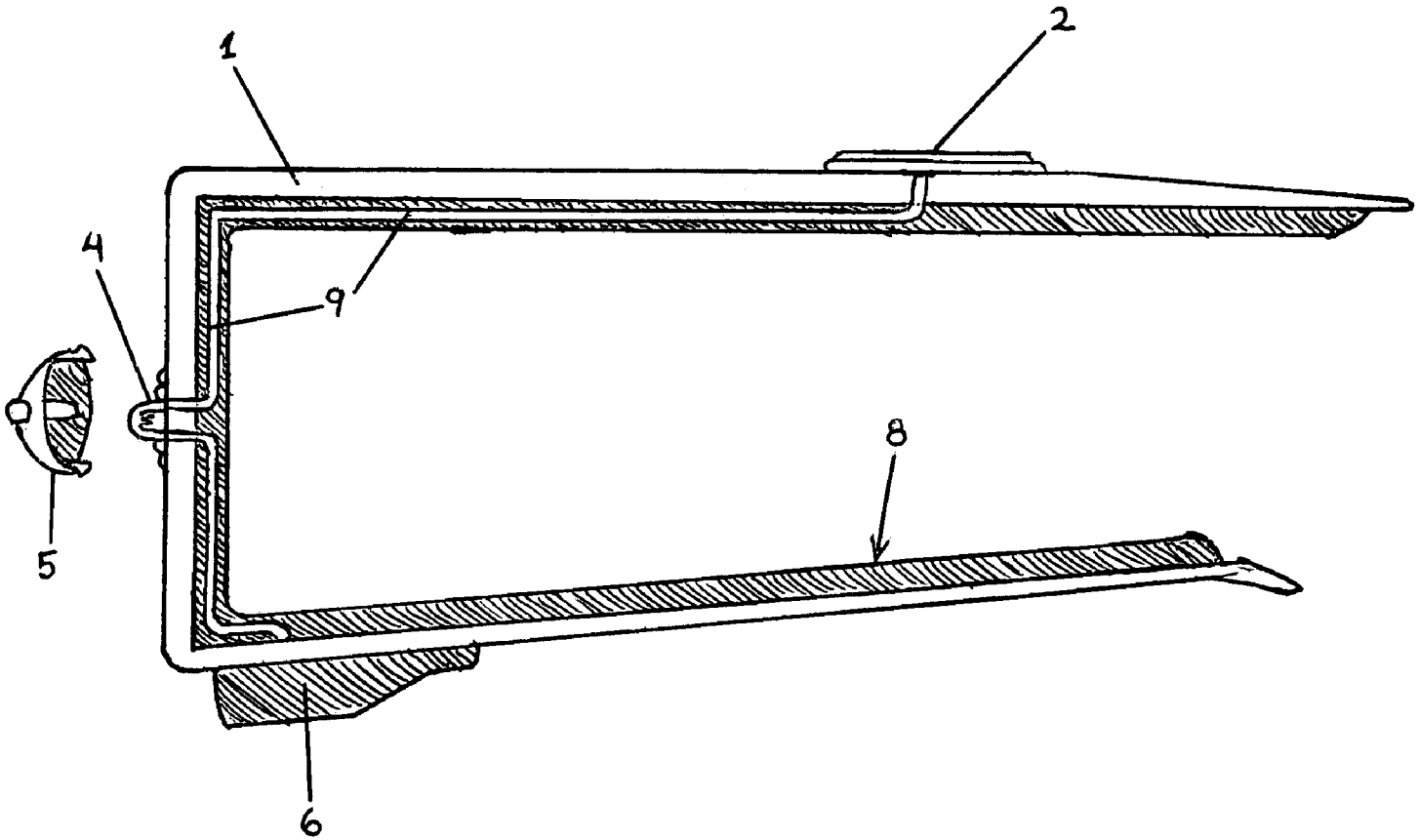
Figure 4:
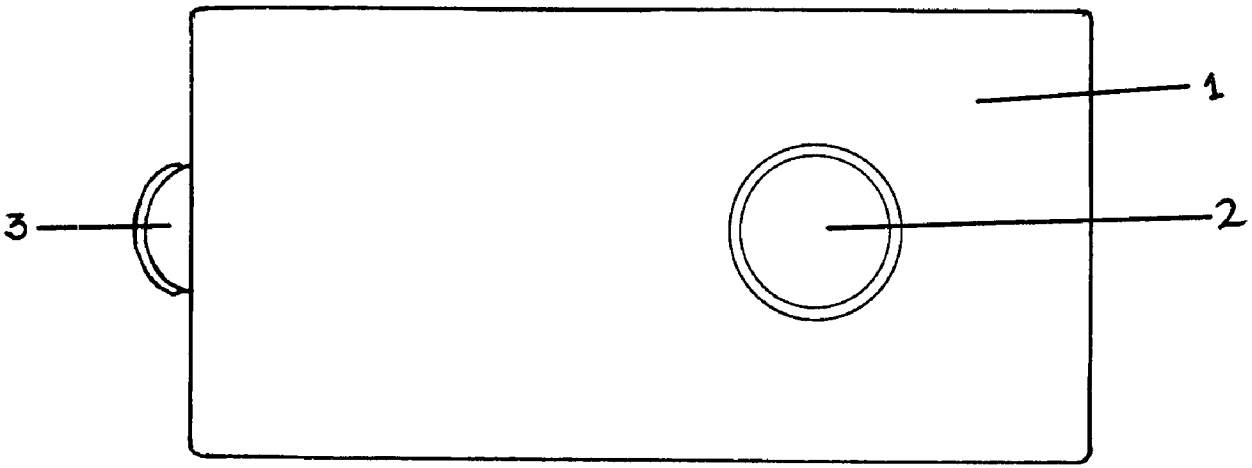
FIG. 4 is a top view of the WCL.
Figure 5:
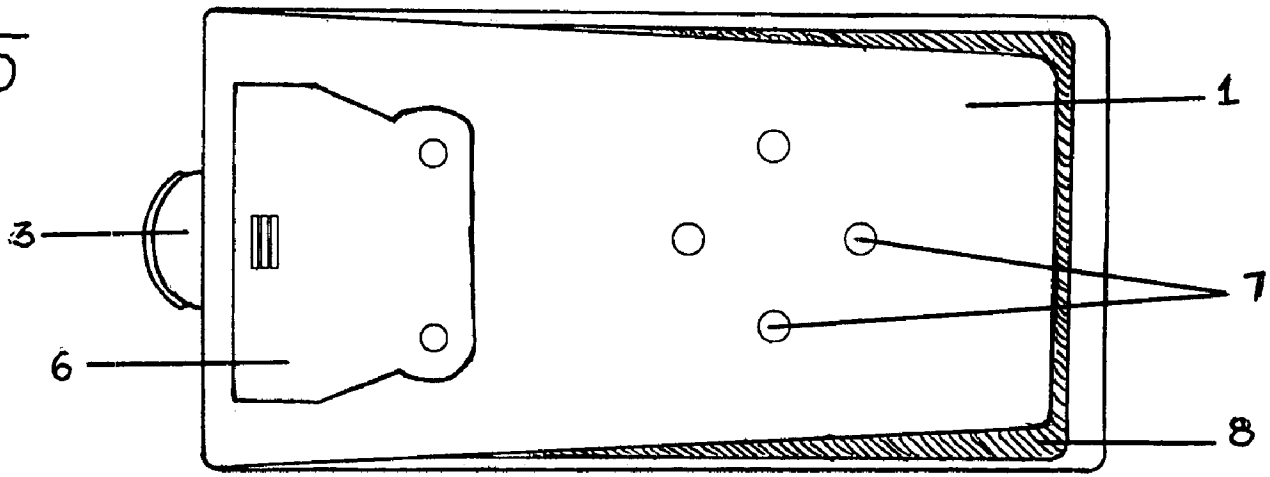
FIG. 5 is a bottom view.
Figure 7:
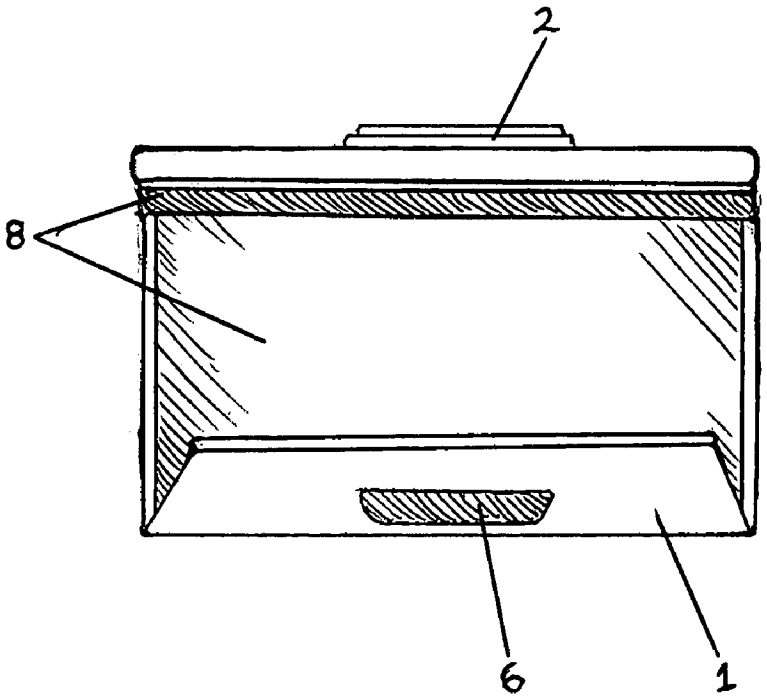
FIG. 7 is a rear view.
Figure 6:
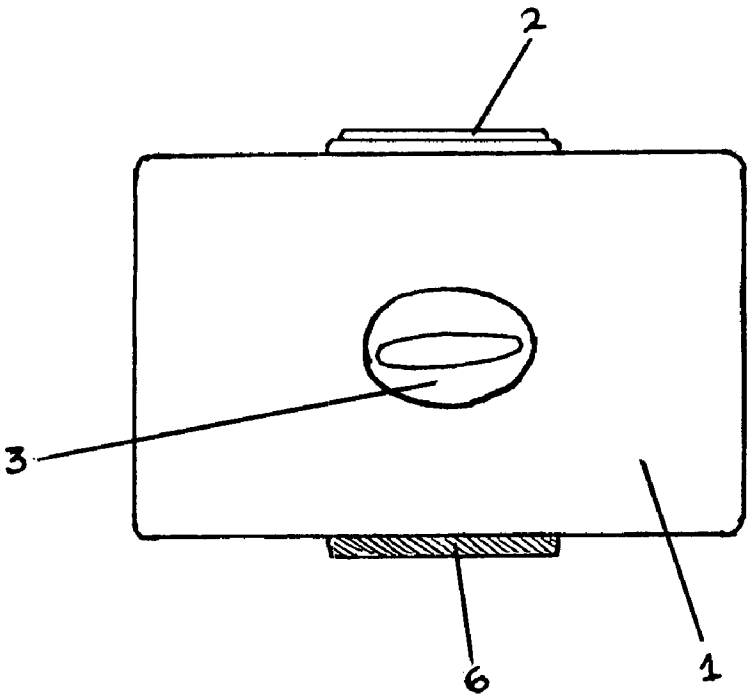
FIG. 6 is a front view.
Figure 8:
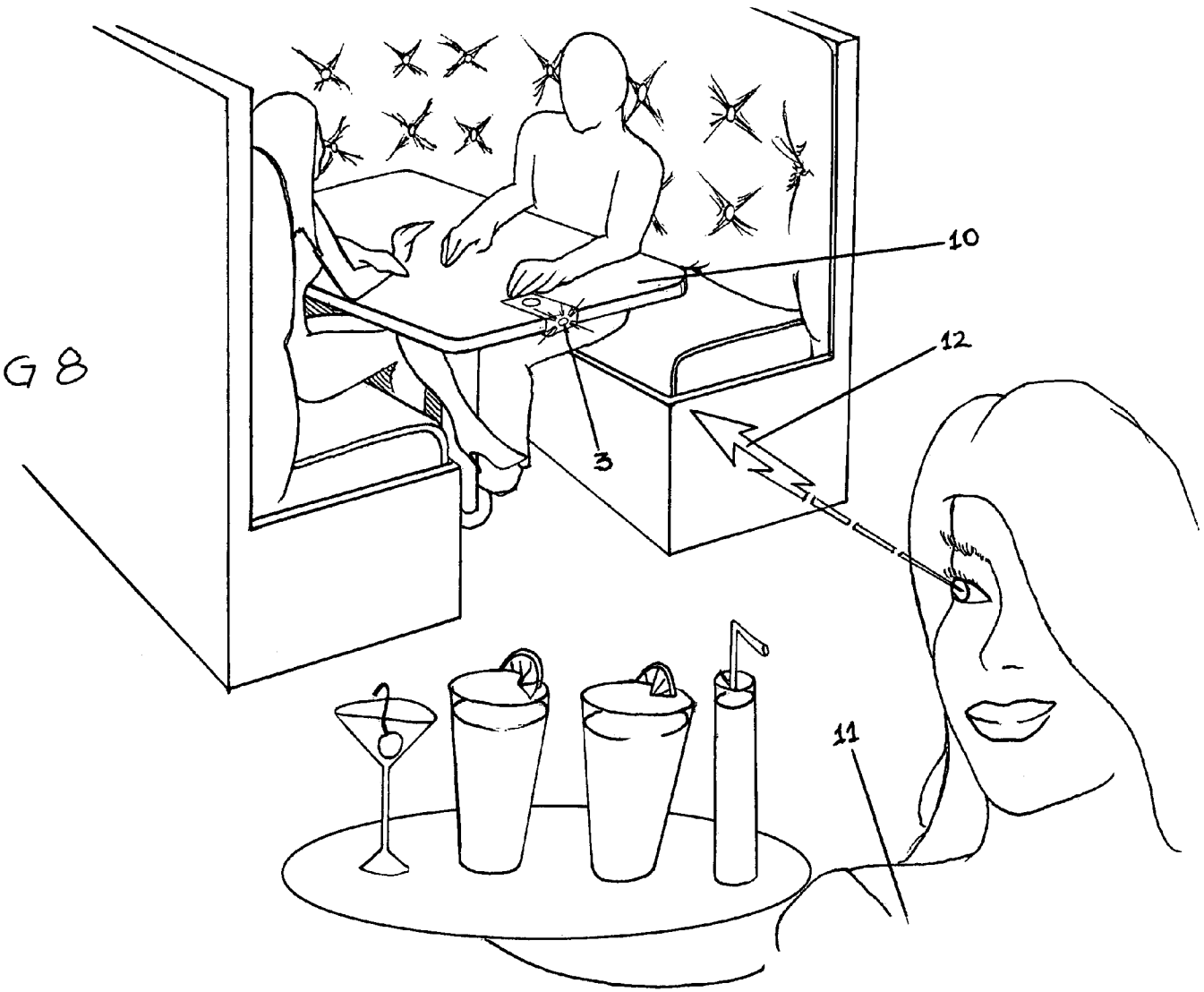
FIG. 8 is a perspective view showing the WCL in use.

The first thing that is required to build the WCL is a clip made/or molded from plastic, metal, fiberglass, wood, or other miscellaneous material shaped to fit the edge of a table so that the WCL will sit securely in place. The preferred material would be a type of metal suitable for making springs, stainless steel would be the preferred. Sizes will vary depth, width, and thickness (gauge) based on table sizes. No matter size or custom shape the clip needs to be able to be secured to the edge of a table. The clip can be designed to be any color (depending on customers taste) by using paint, pigments, polishing metal such as stainless steel or brass, usual methods of coloring.

On the front of the clip (where the edge of the table would be) a light source will be mounted, such as an LED, incandescent, HID, neon, or any type of small bulb of any color that can be easily seen. A blinking light source can be utilized as on option. An LED bulb would be suited best due to it's abilities to generate bright light with very low battery consumption. The light source should be water proof or water resistant and/or mounted in a way that typical washing does not affect functioning.

A button of any size, shape, illuminating (optional), or color (depending on taste of the customer) needs to be mounted on the top of the clip (table top side) and wired to the light source in the standard way so that the button can turn the light on/off. An illuminating button which lights up when the light source is on would be preferred so that the customer can easily identify whether the light source is on or not (especially if a patron isn't positioned to have a clear view of the table edge where the light source is mounted). Another way for the patron to see if the light source is on would be to have a thin plastic sheet (florescent colors may work best) mounted around the light source that would extend above the table top side of the WCL (would look like a plastic strip above the table top) which would be illuminated when the light source is on. A typical switch (flip/toggle as opposed to press/button) can be used but is not preferred (buttons are more practical for the nature of it's usage). Two buttons could be used but would have to be labeled or color coded in a way so both the waiter/waitress and customer understands their meanings. The button should be water proof or water resistant and/or mounted in a way so that typical washing and usage doesn't affect functioning.

On the inside of the clip (where the clip would clamp around the table) the wiring for the button, light source, and battery pack needs to be covered. The ideal lining should be rubber because it can waterproof and conceal the wires as well as help secure the clip to the table. Rubber lining can be glued or secured over the wiring, inner mounting of the battery pack, light source, and button.

On the bottom of the clip (facing the floor) a battery pack for the light source needs to be mounted. The battery pack should be as small and flat as possible so that customers don't snag their clothes or bump their legs or knees when accessing the table. The battery pack could be mounted on the inside of the clip (like behind/underneath the button or light source) but may be impractical for access, may cause clip to protrude, would be harder to conceal wires, etc. The battery pack can be any size (small preferred), shape (square or rectangle preferred) or color (black preferred) just as long as it can easily fit on the clip of the WCL. The battery pack would be best suited to use small batteries such as watch batteries but AA or AAA will work. Larger batteries may be too bulky for practicality.

Caps to go over the light source can be made of any color, size shape, or design to match the decor of a restaurant. The caps should be molded from plastic, glass, or another transparent or semi-transparent material so that the light source can light the cap enough to be visible for the waiter/waitress. Note the WCL doesn't require a cap (the light source can be used alone) but the optional cap can help customize the WCL to match restaurant decor. Along with the light caps, the clip and button can be different colors and shapes to help customize the WCL to match restaurant decor also.

Screw holes can be drilled in the WCL's clip to help for a more permanent mounting to the table. The holes can be drilled anywhere on the clip but the best place would be on the bottom (facing the floor) for concealment. Holes can be drilled in other places for quicker or easier mounting or removal but may be unsightly and cause damage to table finish. Two screw holes should be drilled so that two screws can be inserted to secure the clip to the table and stabilize the WCL from moving. More or less holes can be drilled but is not recommended for practicality.

What is claimed is:

1. A waiter call light device comprising:

A water-resistant unit embodied in whole as a C-shaped tensile clip with at least top, bottom and front faces, two of them parallel faces, connecting and gripping to a table with a spring-action with all parts integrated as part of the clip; containing a light source mounted to the front face, a button to activate and deactivate the light source for signaling a waiter, and a battery pack to power the unit mounted on the bottom face.

2. The waiter signaling device of claim 1 including, a pre-drilled hole or holes in the bottom face for permanent mounting with screws to the table surface.

3. The waiter call light device of claim 1 including, transparent or semi-transparent removable cap mounted over the light source, wherein the cap made of a color, size, shape to match the decor of a restaurant.

4. The waiter call light device of claim 1, wherein said light source when activated is blinking or constant to gain the waiter's attention achieved by a selected bulb.

5. The waiter call light device of claim 1, wherein inside faces of the unit are lined with rubber or like material to grip the table surface and to conceal and seal all parts and wires used to connect the battery pack, light source and button.

6. The waiter call light device of claim 1, wherein said button is illuminating or non-illuminating.

7. The waiter call light device of claim 1, wherein the unit is made of a rigid or semi-rigid material.

* * * * *